US006688109B2

(12) United States Patent
Hein

(10) Patent No.: US 6,688,109 B2
(45) Date of Patent: Feb. 10, 2004

(54) TURBINE ENGINE BURNER

(75) Inventor: Olaf Hein, Muelheim a.d. Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 66 days.

(21) Appl. No.: 10/133,926

(22) Filed: Apr. 26, 2002

(65) Prior Publication Data

US 2002/0174656 A1 Nov. 28, 2002

Related U.S. Application Data

(63) Continuation of application No. PCT/EP00/10167, filed on Oct. 16, 2000.

(30) Foreign Application Priority Data

Oct. 29, 1999 (EP) ..... 99121577

(51) Int. Cl.[7] ..... F23M 9/00; F02K 5/02
(52) U.S. Cl. ..... 60/748; 431/183
(58) Field of Search ..... 431/9, 182, 183; 239/403; 60/39.11, 737, 748

(56) References Cited

U.S. PATENT DOCUMENTS 3,570,242 A * 3/1971 Leonardi et al. ..... 60/737
4,483,138 A 11/1984 Willis
5,451,160 A 9/1995 Becker
5,558,515 A 9/1996 Althaus et al.
5,609,017 A * 3/1997 Althaus ..... 60/778
5,927,076 A 7/1999 Pillsbury
6,374,593 B1 * 4/2002 Ziegner ..... 60/772

FOREIGN PATENT DOCUMENTS

| | | |
|---|---|---|
| DE | 38 36 446 | 5/1990 |
| DE | 44 30 697 | 9/1995 |
| EP | 0 122 526 | 10/1984 |
| EP | 0 572 202 | 12/1993 |

OTHER PUBLICATIONS

Combustion Driven Oscillations in Industry, Abbott Putnam, American Elsevier Publishing Company, New York 1971.

* cited by examiner

*Primary Examiner*—Charles G. Freay

(57) ABSTRACT

The invention relates to a burner (100) having a combustion air duct (104), in which a swirl generator (109), which is formed from a number of swirl generator elements (108), is arranged in such a way that the swirl generator (109) can increase the mean velocity at which combustion air (112) flows through the swirl generator (109) to a Mach number of at least 0.4. This results in flow-acoustic decoupling of the combustion area from the combustion-air feed area.

20 Claims, 3 Drawing Sheets

TURBINE ENGINE BURNER

CROSS-REFERENCE TO RELATED APPLICATIONS

This application is a continution of International Application No. PCT/EP00/10167 filed on Oct. 16, 2000, which claims benefit to the European Patent Application, 99121577.3 filed on Oct. 29, 1999, both of which are incorporated by reference herein in their entirety.

FIELD OF THE INVENTION

The invention relates to a burner having a combustion-air feed duct, and more specifically a burner for use in turbine engines.

BACKGROUND OF THE INVENTION

The present invention relates to the area of cumbustion in turbine engines. The book entitled "Berechnung der Schallausbreitung in durchstromten Kanalen von Turbomaschinen unter besonderer Berücksichtigung der Auslegung von Drehtonschaltern" ["Calculation of the sound propagation in flow ducts of turbomachines, taking particular account of the design of rotational sound switches"] Section 3.4, by Christian Faber, Verlag Shaker, Aachen 1993, illustrates how discontinuities in flow ducts influence the propagation of sound in a fluid flowing in these flow ducts. Scatter, reflection and transmission factors are derived, by means of which it is possible to calculate which part of incident sound energy passes the discontinuity and which part is reflected.

Another reference is German Patent No, DE 44 30 697 C1 which shows an incoming-air sound absorber. The incoming-air sound absorber comprises a flow line which is surrounded by an impervious wall and through which a gaseous medium flows at subsonic speed. A device for suppressing airborne sound emissions is arranged in the flow line. As seen in the direction of flow of the medium, this device is arranged upstream of a sound-emitting noise source and is used to suppress the emissions of airborne sound in the opposite direction to the direction of flow. The device has a constriction, which is similar to a laval nozzle, in the flow line. This constriction, in the form of a laval nozzle, accelerates the velocity of the gaseous medium to the speed of sound. This builds up a reflection barrier to the airborne sound.

Combustion oscillations may occur in combustion systems. Combustion oscillations of this type are described in the article "Combustion-Driven-Oscillations in Industry" by Abbott A. Putnam, American Elsevier, New York 1971. In accordance with the Rayleigh criterion, a combustion oscillation is built up when heat is periodically supplied to a quantity of air in a combustion chamber. This supply of heat takes place as a periodic combustion output release in phase with a characteristic oscillation of the air in the combustion chamber. Accordingly, the combustion oscillation can be suppressed by a release of power of the opposite phase. Combustion oscillations of this type may lead to considerable noise pollution and even to mechanical damage to components of the combustion device. It is stated in the above article, on page 4 under the paragraph "Pulsations in supply rate" that the combustion oscillation may be coupled to an air or fuel supply. To avoid the propagation of pulsations in the supply systems, it has been proposed to bring about a considerable pressure loss in the supply systems, in order in this way to construct a reflection barrier. However, it has already been pointed out that a pressure loss of this type is generally unacceptable.

In the article entitled "Maβnahmen zur Vermeidung von Verbrennungsschwingungen—Kennzahl zur str ömungsakustischen Entkopplung am Brenner" [Measures aimed at avoiding combustion oscillations—characteristic variable for flow-acoustic decoupling at the burner"] by D. Schröder, Gaswärme International, Vol. 41, section 1, January 1992, D. Schröder has developed a flow-acoustic limit value criterion for decoupling a combustion chamber from a coupled system of pipes. The decoupling is effected by a reflection area, which is produced in particular at the burner by means of a narrowing of the cross section of a feed pipe and, if appropriate, in addition by a perforated plate arranged at this cross-sectional narrowing. However, these measures have the drawback of a considerable pressure loss for the medium which is fed to the burner.

SUMMARY OF THE INVENTION

It is an object of the present invention to provide a burner in which a combustion zone into which the burner opens out is decoupled from a feed line for combustion air for the burner in terms of flow acoustics, this decoupling at most resulting in an acceptable additional pressure loss in the combustion air.

According to the present invention, one object is achieved by a burner having a combustion air duct, in which a swirl generator, which is formed from a number of swirl-generator elements, is arranged in such a way that the swirl generator increases the mean velocity at which the combustion air passes through the swirl generator to a Mach number of at least 0.4, in particular at least 0.6. The mean velocity of flow in this context is the mean formed for the velocity over a cross section of the combustion air duct.

Swirl generators are often used in a burner to impart a swirl, which stabilizes the combustion flame, to the combustion air entering the combustion chamber. A reflection barrier for sound waves is built up using the swirl generators by means of simultaneous acceleration of the combustion air by means of the swirl generators to a Mach number of at least 0.4. This weakens or even suppresses the propagation of combustion oscillations into the feed line system for combustion air. By building up the reflection barrier by means of the swirl generator, a pressure loss in the combustion air can be kept at a low level. Therefore, the acoustic decoupling has at most a slight negative effect on the efficiency of a combustion device in which the burner is integrated.

It is preferable for a swirl-blade ring comprising swirl blades for imparting a swirl to the combustion air to be arranged in the combustion air duct. It is also preferable for the swirl generator to be formed by the swirl-blade ring. Therefore, instead of providing additional swirl generators for acoustic decoupling, a swirl-blade ring which is present in any case is designed as an acoustically decoupling swirl generator. Designing the swirl-generating elements as swirl blades results in a measure which is easy to implement in order to keep the pressure loss in the combustion air at a low level. This is because acceleration of the combustion air when it enters the swirl-blade ring as a result of an effective narrowing of the cross section is followed again by a widening, by means of which pressure is recovered in the combustion air, on account of the blade profiles which narrow in the direction of flow. Therefore, designing the flow generator as a swirl-blade ring has the advantage both that a means which is already present is provided for generating a combustion-stabilizing swirl, and that pressure recovery, which has a favorable effect on efficiency, becomes possible in the combustion air.

The swirl-blade ring preferably has first and second blades which alternate with one another over the circumferential direction of the swirl-blade ring, the second blades being offset with respect to the first blades in the opposite direction to a direction of flow of the combustion air. The first blades preferably have a first maximum profile thickness and the second blades preferably have a second maximum profile thickness, the first maximum profile thickness being greater than the second maximum profile thickness.

The first blades have a first chord length and the second blades have a second chord length. In this context, the first chord length is preferably shorter than the second chord length. The swirl generator is therefore formed to a certain extent from two partial blade rings which engage in one another in an offset manner in the direction of flow. The blades of one of the partial rings are preferably longer and thinner than the blades of the other partial ring, and specifically it is preferable for the blades of that partial ring which is arranged in front of the other partial ring, as seen in the direction of flow, to be longer and thinner. This design enables the two methods of operation of the swirl-blade ring to be optimized, i.e. both the function of swirl generation and the function of acoustic decoupling can be fulfilled to a sufficient extent by suitable dimensioning and matching of the partial rings to one another.

Furthermore, this structure results in a simple way of retrofitting a swirl-blade ring in a burner in such a way that it subsequently allows the desired acoustic decoupling. For this purpose, it is simply necessary for a further swirl-blade ring to be inserted into the existing swirl-blade ring. This is achieved by arranging an additional swirl blade between in each case two existing swirl blades. Suitable dimensioning of the additional swirl blades results in the desired acceleration of the combustion air to a Mach number of over 0.4, preferably over 0.6, more preferably over 0.8. At the same time, the profile of the additional swirl blades is designed in such a way that a recovery of pressure is achieved in the combustion air. This is preferably achieved by means of a gradually widening passage cross section. In particular, this gradual widening is to be designed in such a way that there is no flow separation along the swirl blades.

The combustion air duct is preferably of annular design. Preferably, fuel can be admitted to the combustion air duct, and in the process this fuel is intensively mixed with the combustion air prior to combustion. Furthermore, it is preferable for it to be possible for the fuel to be admitted from at least some of the swirl-generating elements. The intensive mixing of the fuel with the combustion air prior to combustion (premix burner) leads to a reduction in the emissions of nitrogen oxides. This is achieved by making the flame temperature more uniform on account of intimate mixing, since the emissions of nitrogen oxides rises exponentially with the flame temperature. A further advantage of the acoustic decoupling by means of the swirl generator is additional mixing of fuel and combustion air, since, on account of the pronounced acceleration of the combustion air and of the adjoining zone of pressure recovery, additional turbulence in the combustion air leads to a further improvement in the mixing of combustion air and fuel. If appropriate, the swirl generator may also be dimensioned in such a way that some of the pressure recovery is dispensed with in favor of mixing which is improved by increased turbulence.

The burner preferably has an additional pilot burner, which is used to stabilize combustion of the fuel/combustion air mixture emerging from the combustion air duct. If the pilot burner operates as a diffusion burner, i.e. fuel and combustion air in the pilot burner are only mixed at the location of combustion, the burner is also known as a hybrid burner, in which both premix combustion and diffusion combustion takes place.

The burner is preferably designed as a gas turbine burner. Particularly in the case of a high power conversion of a gas turbine, combustion oscillations with very high amplitudes and possibly considerable damaging effects may occur. The flow-acoustic decoupling from the combustion-air supply system is of particular importance in this context. This applies in particular to stationary gas turbines.

BRIEF DESCRIPTION OF THE DRAWINGS

The invention is explained in more detail by way of example with reference to the drawing, in which, in some cases diagrammatically and not to scale.

DETAIL DESCRIPTION OF THE INVENTION

It is noted that identical reference symbols have the same meaning throughout the various figures.

Figure 1:
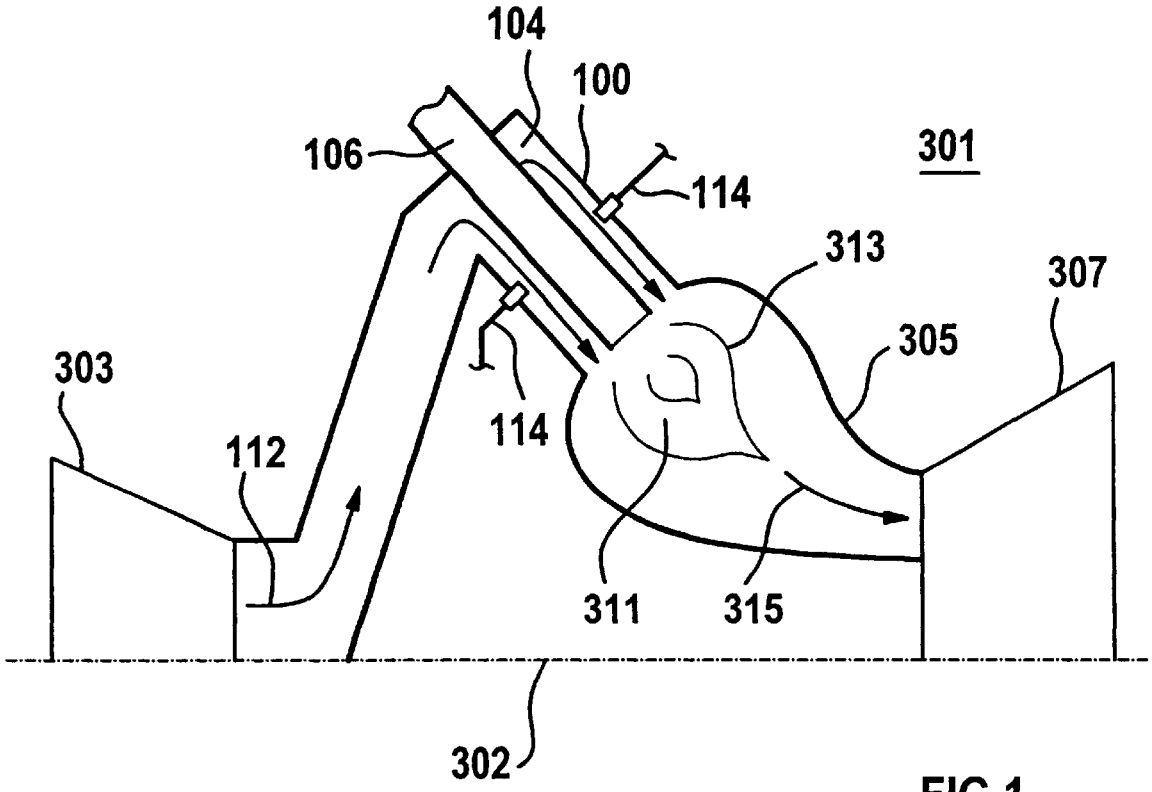
FIG. 1 shows a longitudinal cross sectional view of a combustor configuration for a gas turbine engine.

Referring to FIG. 1 there is shown a longitudinal section through a gas turbine 301. A compressor 303, a combustion chamber 305 and a turbine part 307 are arranged in series one behind the other along a turbine axis 302. The combustion chamber 305 opens out into the burner 100, which comprises an annular combustion air duct 104 and a central pilot burner 106, which is surrounded by the combustion air duct 104.

The pilot burner 106 is designed as a diffusion burner, in which fuel 114 and combustion air 112 are mixed and burnt in a combustion zone 311. Fuel 114 is mixed with the combustion air 112 from the compressor 303 in the combustion air duct 104, upstream of the combustion zone 311. Therefore, the combustion air 112 is initially intimately mixed with the fuel 114, before likewise being burnt in the combustion zone 311 within the combustion chamber 305. This process, which is known as premix combustion, is stabilized by the diffusion combustion of the pilot burner 106. During the combustion in the combustion chamber 305, hot exhaust gas 315 is generated and is fed to the turbine part 307. The energy of the hot exhaust gases 315 is converted into rotational energy of a turbine shaft (not illustrated in more detail) by an arrangement of blades and vanes in the turbine part 307, which are not shown in more detail, but its operation is understood to one skilled in the art.

Fluctuations in the combustion flame 313 result in propagation of sound waves within the combustion chamber 305, these sound waves being reflected by the combustion-chamber walls and in turn causing fluctuations in the flame 313 at the location of combustion 311. At certain frequencies of the fluctuations, this interaction makes it possible to build up a stable combustion-chamber oscillation in the combustion chamber 305, which may lead to considerable noise being produced or even to damage to components of the gas turbine 301. These combustion oscillations also propagate through the combustion air duct 104.

Therefore, an additional volume, which can additionally promote the formation of combustion-chamber oscillations, is coupled to the combustion chamber 305 through the combustion air duct 104. Moreover, under certain circumstances components upstream of the combustion chamber 305 are also exposed to damaging vibrations. Therefore, it is desirable for the combustion air duct 104 to be decoupled from the combustion chamber 305 in terms of flow acoustics. For this purpose, it is necessary to build up a reflection barrier for the sound waves from the combustion chamber 305. However, a simple narrowing of the cross section or the use of a perforated plate or the like would impair the efficiency of the gas turbine 301 to such an extent that economic operation would no longer be possible. One possible way of acoustically decoupling combustion chamber 305 and combustion air duct 104 by means of a burner 100 which is simple and acceptable in terms of the pressure loss is shown in FIG. 2.

Figure 2:
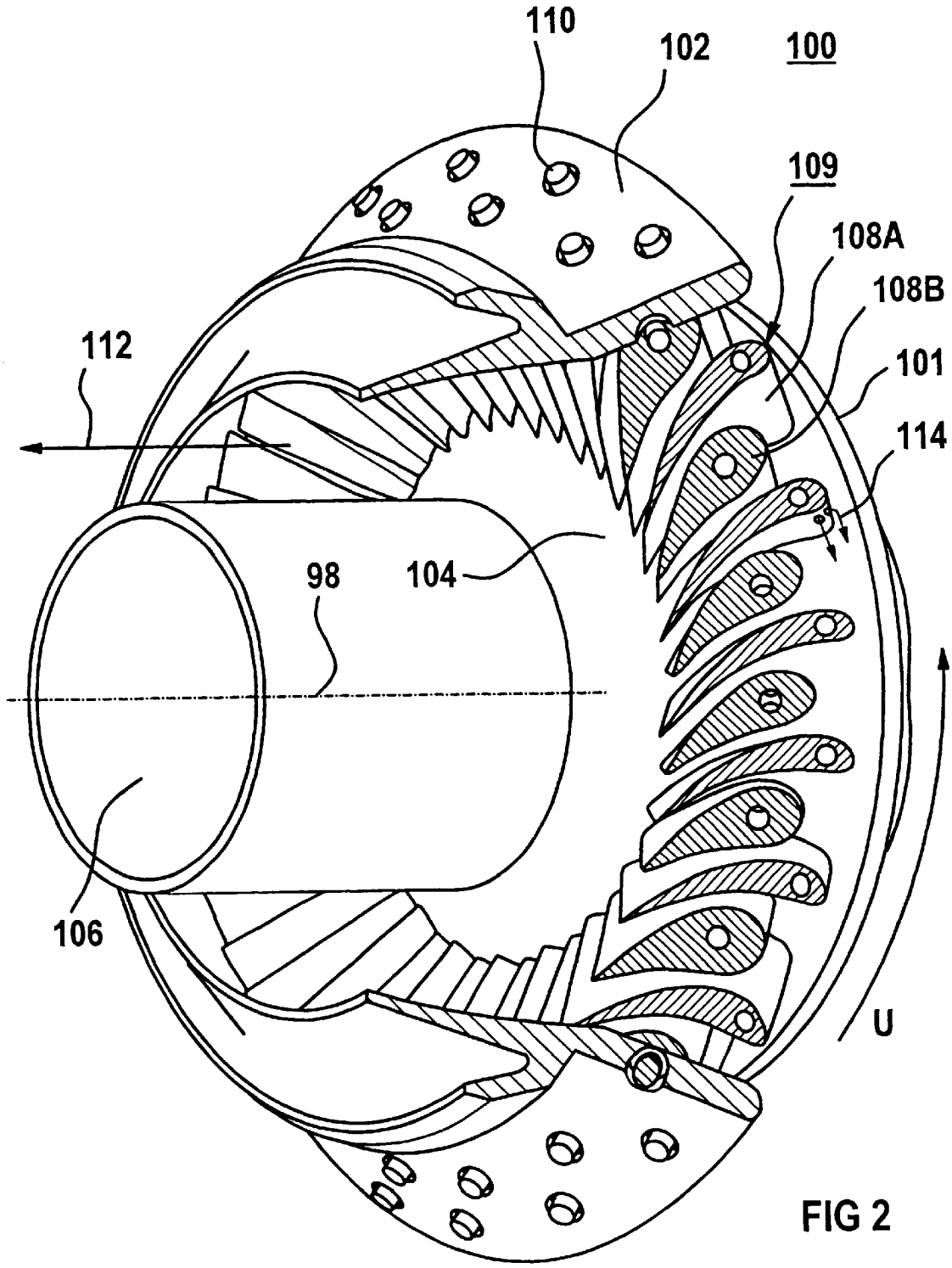
FIG. 2 shows a cut away view of a swirler assembly in accordance with the present invention.

Referring now to FIG. 2, a partially sectional, perspective view of a burner 100 which is directed along a combustion axis 98 is shown. An annular combustion air duct 104 is formed by an inner wall 101 and an outer wall 102. This duct surrounds a centrally arranged pilot burner 106, which is not shown in detail. A swirl generator 109, which is designed as a swirl-blade ring, is arranged in the combustion-air duct 104. This swirl generator is formed from swirl-generator elements 108 which are designed as swirl blades. The position of the swirl blades 108 can be adjusted by means of adjustment bolts 110 in the outer wall 102. The swirl-blade ring 109 is formed from different swirl blades 108 which alternate with one another along its circumferential direction U. A first swirl blade 108B is in each case followed by a second swirl blade 108A. The first swirl blades 108B are offset with respect to the second swirl blades 108*a*, and are designed to be both shorter and thicker. This is explained in more detail below with reference to FIG. 3.

Fuel 114 is admitted to the combustion air duct 104, via openings, in particular around the blade-inlet edge, from some, preferably all of the swirl blades 108, by means of a fuel duct, which runs inside the swirl blade 108 and cannot be seen in this figure. Combustion air 112 flows through the combustion air duct 104. This air is mixed intensively with the fuel 114. The dimensioning of the swirl blades 108 accelerates the combustion air 112 to a Mach number of over 0.4. As a result, a reflection barrier for sound waves is built up. This leads to acoustic decoupling of the combustion chamber 305, into which the burner 100 opens, and that part of the combustion air duct 104 which lies upstream of the swirl generator 109. The combustion air 112 is accelerated by a narrowing in the passage cross section for the combustion air 112. On account of the design of the profile of the swirl blade 108, this narrowing is adjoined by a widening of this passage cross section, in such a way that as far as possible there is no flow separation for the combustion air 112. This ensures a high recovery of pressure in the combustion air 112, so that there are at most slight losses in efficiency.

Figure 3:
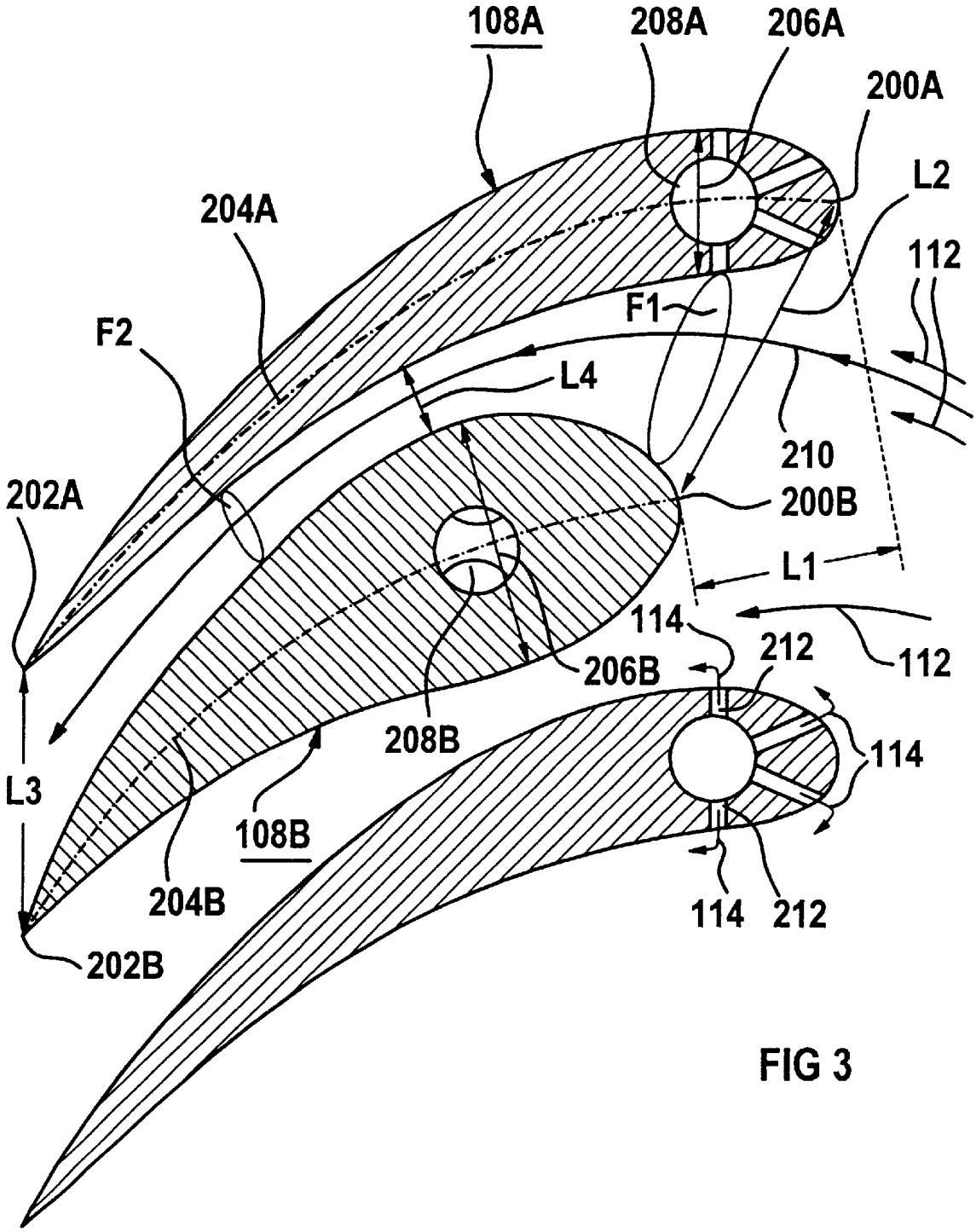
FIG. 3 shows the swirler blades of the turbine engine burner in accordance with the present invention.

Now referring to FIG. 3 a cross section is shown through three of the swirl blades 108, specifically second swirl blades 108A and an intervening first swirl blade 108B. The first swirl blade 108B has a blade front-edge point 200B, a blade rear-edge point 202B, a skeleton line 204B, a maximum profile thickness 206B and an adjustment engagement feature 208B. In a corresponding way, every second swirl blade 108A has in each case a blade front-edge point 208A, a blade rear-edge point 202A, a skeleton line 204A, a maximum profile thickness 206A and an adjustment engagement means 208A.

Combustion air 112 flows in the direction of flow 210 between the first swirl blade 108B and one of the second swirl blades 108A. Along this direction of flow 210, the first swirl blade 108B is set back with respect to the second swirl blades 108A, so that a distance L1 results between the tangents on the respective blade front-edge points 200B, 200A.

A passage cross section F1 for the combustion air 112 flowing between the swirl blades 108 is reduced to a maximum constriction, which is characterized by a minimum distance L4 between the first swirl blade 108B and the second swirl blade 108A. After this maximum constriction, the passage cross section F2 increases again, specifically in such a moderate way that there is no flow separation and therefore no pressure losses on account of the formation of turbulence. This ensures a high recovery of pressure in the combustion air 112.

Between the blade rear-edge points 202B, 202A, the combustion air 112 emerges again between the two blades 108. The blade rear-edge points 202B, 202A are separated from one another by the distance L3. The first swirl blades 108B have both a greater maximum profile thickness 206B and a shorter profile chord 204B compared to the maximum profile thickness 206A and the profile chords 204A of the second swirl blades 108A. This alternating design of the blades in the swirl-blade ring 109 makes it possible both to set a sufficiently high swirl to stabilize combustion and also the desired acoustic decoupling effect by acceleration of the combustion air 112 and subsequent pressure recovery.

In their front region, i.e. along the skeleton line 204A from the blade front-edge point 200A, the second swirl blades 108A have, in the first quarter, feed passages 212, through which fuel 114 which is guided in the interior of the swirl blades 108A can be released into the combustion air 112. This leads to particularly intimate mixing of combustion air 112 and fuel 114 even in the region of the swirl generator 109.

Moreover, the location of combustion is separated from the location where the mixture is formed, since the decoupling constriction lies downstream of the fuel supply. As a result, the fuel supply, which in general can often be regarded as the cause of fluctuations, is acoustically decoupled from the combustion. This acoustic decoupling of the cause of combustion oscillations leads to combustion oscillations being suppressed particularly effectively. The following values are preferably set for the dimensions of the swirl blades 108 and the distances between them:

L1=distance between the tangents on the blade front-edge points 200B, 200A=1 to 5 cm, L2=distance between the blade front-edge points 200B, 200A=2 to 8 cm, L3=distance between the blade rear-edge points 202B, 202A=1 to 5 cm, L4=minimum distance between the first swirl blades 108B and the second swirl blades 108A=0.3 to 3 cm, maximum profile thickness 206B of the first swirl blades 108B=2 to 6 cm, length of the skeleton line 204B of the first swirl blade 108B=5 to 17 cm, maximum profile thickness 206A of the second swirl blade 108A=0.5 to 4 cm, and skeleton line length of the profile chord 204A of the second swirl blade 208A=8 to 20 cm.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A burner for a combustion engine having;

a combustion air duct in which combustion air passes there through in which a swirl generator is formed from a number of swirl-generator elements wherein the elements are arranged in such a way that the swirl generator can be used to increase the mean velocity at which the combustion air passes through the swirl generator to a Mach number of at least 0.4.

2. The burner as claimed in claim 1, further having a swirl-blade ring comprising swirl blades arranged in the combustion air duct for imparting a combustion-stabilizing swirl to the combustion air.

3. The burner as claimed in claim 2, in which the swirl generator is formed by the swirl-blade ring, and wherein the swirl-generating elements being formed by the swirl blades.

4. The burner as claimed in claim 3, wherein the swirl-blade ring is formed from first swirl blades and from second swirl blades, which follow one another alternately in the circumferential direction of the swirl-blade ring, the second swirl blades being offset with respect to the first swirl blades in the opposite direction to a direction of flow of the combustion air.

5. The burner as claimed in claim 4, wherein the first swirl blades have a maximum profile thickness and the second swirl blades have a second maximum profile thickness, with the first maximum profile thickness being greater than the second maximum profile thickness.

6. The burner as claimed in claim 4, wherein the first swirl blades have a first profile chord length and the second swirl blades have a second profile chord length, with the first profile chord length being shorter than the second profile chord length.

7. The burner as claimed in claim 2, in which the flow velocity is increased by narrowing a free passage cross section for the combustion air and a subsequent recovery of pressure in the combustion air is achieved by a free passage cross section which widens gradually in such a way that the combustion air flows between the swirl-generating elements substantially without a flow separation.

8. The burner as claimed in claim 1 wherein the combustion air duct is of annular design.

9. The burner as claimed in claim 1, wherein fuel can be admitted to the combustion air duct wherein the fuel is mixed intensively with the combustion air prior to combustion.

10. The burner as claimed in claim 9, in which the fuel can be admitted from at least some of the swirl-generating elements.

11. The burner as claimed in claim 9 further comprises an additional pilot burner by means of which combustion of the fuel/combustion air mixture emerging from the combustion air duct can be stabilized.

12. The burner as claimed in claim 1 wherein the burner is designed as a gas turbine engine burner.

13. A burner for a combustion engine having;

a combustion air duct in which combustion air passes there through in which a swirl generator is formed from a number of swirl-generator blades wherein the blades are arranged in such a way that the swirl generator can be used to increase the mean velocity at which the combustion air passes through the swirl generator to a Mach number of at least 0.4.

14. The burner as claimed in claim 13, wherein the swirl blades form a swirl-blade ring further having first swirl blades and second swirl blades, which follow one another alternately in the circumferential direction of the swirl-blade ring, the second swirl blades being offset with respect to the first swirl blades in the opposite direction to a direction of flow of the combustion air.

15. The burner as claimed in claim 14, wherein the first swirl blades have a maximum profile thickness and a first profile chord length, the second swirl blades have a second maximum profile thickness and a second profile chord length;

wherein the first maximum profile thickness being greater than the second maximum profile thickness and, the first profile chord length being shorter than the second profile chord length.

16. The burner as claimed in claim 15, in which the flow velocity is increased by narrowing a free passage section between the first and second swirl blades for the combustion air and a subsequent recovery of pressure in the combustion air is achieved by the free passage section between the first and second swirl blades which widens gradually in such a way that the combustion air flows between the swirl blades substantially without a flow separation.

17. The burner as claimed in claim 13 wherein the combustion air duct is of annular design.

18. The burner as claimed in claim 16, wherein fuel can be admitted from at least some of the swirl blades to the combustion air duct wherein the fuel is mixed intensively with the combustion air prior to combustion.

19. The burner as claimed in claim 18 which comprises an additional pilot burner by means of which combustion of the fuel/combustion air mixture emerging from the combustion air duct can be stabilized.

20. The burner as claimed in claim 13 wherein the burner is designed as a gas turbine engine burner.

* * * * *